US008201395B2

(12) United States Patent
Woodcock et al.

(10) Patent No.: US 8,201,395 B2
(45) Date of Patent: Jun. 19, 2012

(54) VARIABLE POSITION CATALYST

(75) Inventors: Troy Woodcock, Thaon-les-Vosges (FR); Charles King-Cox, Thaon-les-Vosges (FR); Chris Middlemass, Farmington, MI (US); Edouard Massart, Thaon-les-Vosges (FR)

(73) Assignee: Honeywell International Inc., Morristown, NJ (US)

( * ) Notice: Subject to any disclaimer, the term of this patent is extended or adjusted under 35 U.S.C. 154(b) by 1295 days.

(21) Appl. No.: 10/574,256

(22) PCT Filed: Oct. 20, 2003

(86) PCT No.: PCT/EP03/11598

§ 371 (c)(1),
(2), (4) Date: Feb. 6, 2007

(87) PCT Pub. No.: WO2005/042937

PCT Pub. Date: May 12, 2005

(65) Prior Publication Data

US 2007/0261396 A1 Nov. 15, 2007

(51) Int. Cl.
*F01N 3/00* (2006.01)

(52) U.S. Cl. ..... 60/288; 60/274; 60/280; 60/287; 60/299

(58) Field of Classification Search ..... 60/287, 60/288, 297, 299; 422/177, 174, 178, 180, 422/211, 219

See application file for complete search history.

(56) References Cited

U.S. PATENT DOCUMENTS

| | | | | |
|---|---|---|---|---|
| 4,573,317 | A * | 3/1986 | Ludecke | 60/303 |
| 4,671,810 | A * | 6/1987 | Dietzsch et al. | 96/125 |
| 5,009,856 | A * | 4/1991 | Fenger et al. | 422/178 |
| 5,058,380 | A * | 10/1991 | Pelters et al. | 60/288 |
| 5,356,597 | A * | 10/1994 | Wright et al. | 422/169 |
| 5,470,364 | A * | 11/1995 | Adiletta | 55/484 |
| 5,474,751 | A * | 12/1995 | Sigling et al. | 423/239.1 |
| 2002/0141910 | A1 * | 10/2002 | Adiletta | 422/171 |
| 2003/0074888 | A1 * | 4/2003 | Jobson et al. | 60/274 |
| 2008/0060351 | A1 * | 3/2008 | Pawson et al. | 60/299 |

* cited by examiner

*Primary Examiner* — Thomas Denion
*Assistant Examiner* — Jesse Bogue
(74) *Attorney, Agent, or Firm* — Brian Pangrle

(57) ABSTRACT

A variable position catalyst includes a catalyst housing (7) accommodating a catalyst body (1) and an actuator member (9) for moving the catalyst body (1) with respect to the catalyst housing (7) such that the catalyst body (1) can be moved to an active catalyst position (35) or to an inactive catalyst position (14). The variable position catalyst is incorporated in the exhaust line of an internal combustion engine upstream of a turbocharger. The variable position catalyst can be controlled such that the catalyst body (1) is moved to the active catalyst position (35) when the engine is in a predetermined first operation state, and the catalyst body is moved to the inactive catalyst position (14) when the engine is in a predetermined second operation state.

29 Claims, 2 Drawing Sheets

VARIABLE POSITION CATALYST

TECHNICAL FIELD

The present invention refers to a variable position catalyst, an internal combustion engine having such a variable position catalyst and a method for controlling a variable position catalyst incorporated in an internal combustion engine.

BACKGROUND

The introduction of a turbocharger into an internal combustion engine equipped with a catalyst is known. The turbocharger is driven by the exhaust gas coming from the engine and compresses air to be supplied to the engine so as to supply the engine with an increased amount of oxygen which results in generation of more power. As a result, the turbocharger consumes heat from the exhaust gas.

On the one hand, the catalyst is disposed in the exhaust line of the engine at a position downstream of the turbocharger and is arranged there so as to absorb emissions of the exhaust gas. Such a catalyst may for example be an oxidation catalyst which for the reduction of NOx and the oxidation of HC and CO requires a certain temperature level for working reliably. This means, that a certain period of time is needed from the beginning of the start of the engine until the exhaust gas has provided enough heat to warm-up the catalyst.

However, since the turbocharger is arranged in the exhaust line upstream of the catalyst and reduces the temperature of the exhaust gas, the warming-up of the catalyst may be delayed resulting in an extended period of time in which the catalyst does not work properly and in which an exhaust gas having a higher level of emissions is discharged to the environment (cold-start emissions).

To cope with this problem it has been proposed to arrange a pre-catalyst at the upstream side of the turbocharger. This position provides the pre-catalyst with a faster light-off performance which results in a decrease of the cold-start emissions.

There is a need to provide an improved pre-catalyst for an internal combustion engine having a turbocharger.

BRIEF DESCRIPTION OF THE DRAWINGS

In the following description, further technical solutions are described in detail with reference being made to the enclosed drawings, in which.

DETAILED DESCRIPTION

Figure 1:
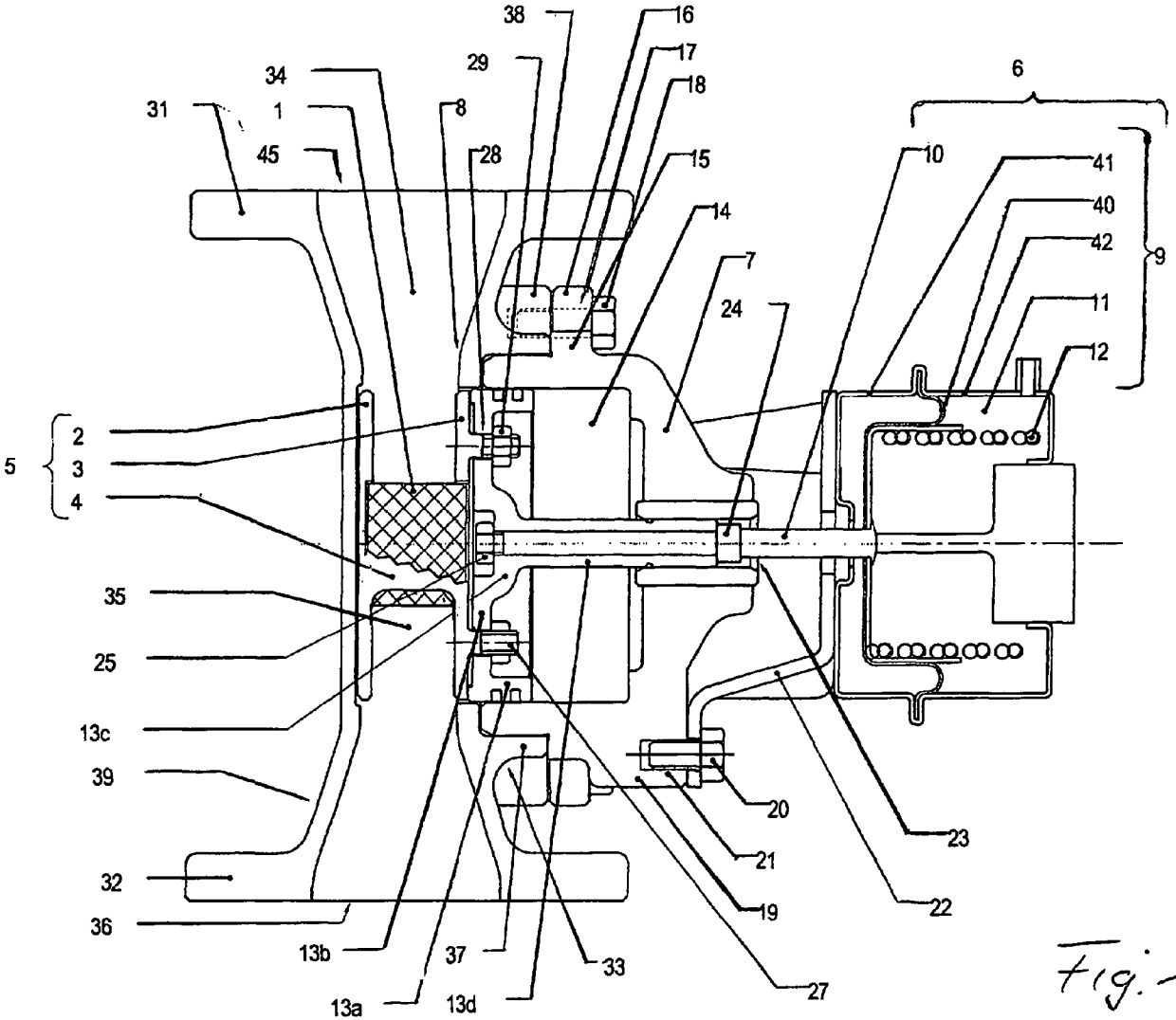
FIG. 1 is a sectional view of the variable position catalyst according to an embodiment of the invention, wherein a catalyst body is in an active. catalyst position.

In an exemplary embodiment of the invention, a variable position catalyst includes a catalyst housing accommodating a catalyst body, and an actuator member for moving the catalyst body with respect to the catalyst housing such that the catalyst body can be moved to an active catalyst position or to an inactive catalyst position. With such a catalyst structure it is possible to bring the catalyst in an appropriate position according to the state of an internal combustion engine.

According to exemplary embodiments, the active catalyst position may be exposed to an exhaust gas stream of an engine. Furthermore, at least the inactive catalyst position may be provided within the catalyst housing. As a result, the catalyst body may be exposed to an exhaust gas flowing at the active catalyst position at a warming-up period of the engine and may be retracted to the inactive catalyst position in which the catalyst does not disturb the exhaust stream, and/or is not exposed to a substantial amount of the exhaust stream, when the engine is warmed up. This brings the advantageous effect that emissions in the exhaust gas can be absorbed at a cold start period of the engine. Furthermore, when the catalyst body is retracted from the exhaust gas, the gas stream to a turbocharger will not be disturbed, or will be substantially less disturbed than when the catalyst is in the active position.

Furthermore, the catalyst body may be held by a cradle connected to the actuator member by an actuator rod. Additionally, the catalyst housing may have a cylindrical inner shape and the cradle may have a cylindrical outer shape, the inner diameter of the housing fitting to the outer diameter of the cradle. This ensures a good guiding performance of the catalyst body and the cradle itself advantageously adapts the shape of the catalyst body to the shape of the catalyst housing, which both are formed according to different requirements.

The cradle may also include two disc-shaped plates between which the catalyst body is held. Thus, the catalyst body may be held stably between the plates while allowing a good accessibility of the exhaust gas to the catalyst body.

The actuator member may be a pneumatic device. Alternatively, the actuator member may be an electric device. As a result, the variable position catalyst may beneficially be actuated by a means which is appropriate to different application areas.

Furthermore, the actuator rod may move the catalyst body to the active catalyst position when the actuator is actuated, and may move the catalyst body to the inactive catalyst position when the actuator is released. Thus, an actuation is only necessary during the cold-start period while the actuator may remain released for the major part of a long-range route of a vehicle, or when the vehicle is off.

The catalyst body, the catalyst housing and the actuator member may include one common axis along which the catalyst body is movable. Since the actuator member may be located outside the catalyst housing, and the actuator rod may penetrate the catalyst housing along the common axis, an easy assembly of the components of the variable position catalyst can be reached.

Additionally, the cradle may include a leading edge which is always in contact with a portion of the catalyst housing providing the inactive position. This improves the guiding performance of the cradle while moving the same between the active and the inactive catalyst position.

The variable position catalyst may be provided upstream of a turbocharger of an engine. Thus, the variable, position catalyst may advantageously advance the warm-up of the turbocharger when disposed in its active position while additionally reducing cold-start emissions of the exhaust gas. Furthermore, the variable position catalyst advantageously does not disturb the exhaust stream to the turbocharger when disposed in its inactive position after the engine and a common catalyst downstream the turbocharger have reached their working temperatures.

According to a further exemplary embodiment, in an internal combustion engine an exhaust gas of the engine may be passed through an exhaust gas passage. The combustion engine may further include a variable position catalyst as described above and a turbocharger disposed downstream the variable position catalyst. Thus, the above described advantages can be obtained for an internal combustion engine.

According to a further exemplary embodiment, a method for controlling a variable position catalyst incorporated into a combustion engine as described above may be provided, wherein the catalyst body may be moved to the active catalyst position when the engine is in a predetermined first operation state, and the catalyst body may be moved to the inactive catalyst position when the engine is in a predetermined second operation state. Furthermore, the first and the second operation state of the engine may be dependent at least on the temperature of the engine. This makes it possible to control the variable position catalyst in the above described manner, so as to advantageously reduce cold-start emissions while minimizing the performance drop of the turbocharger.

Figure 2:
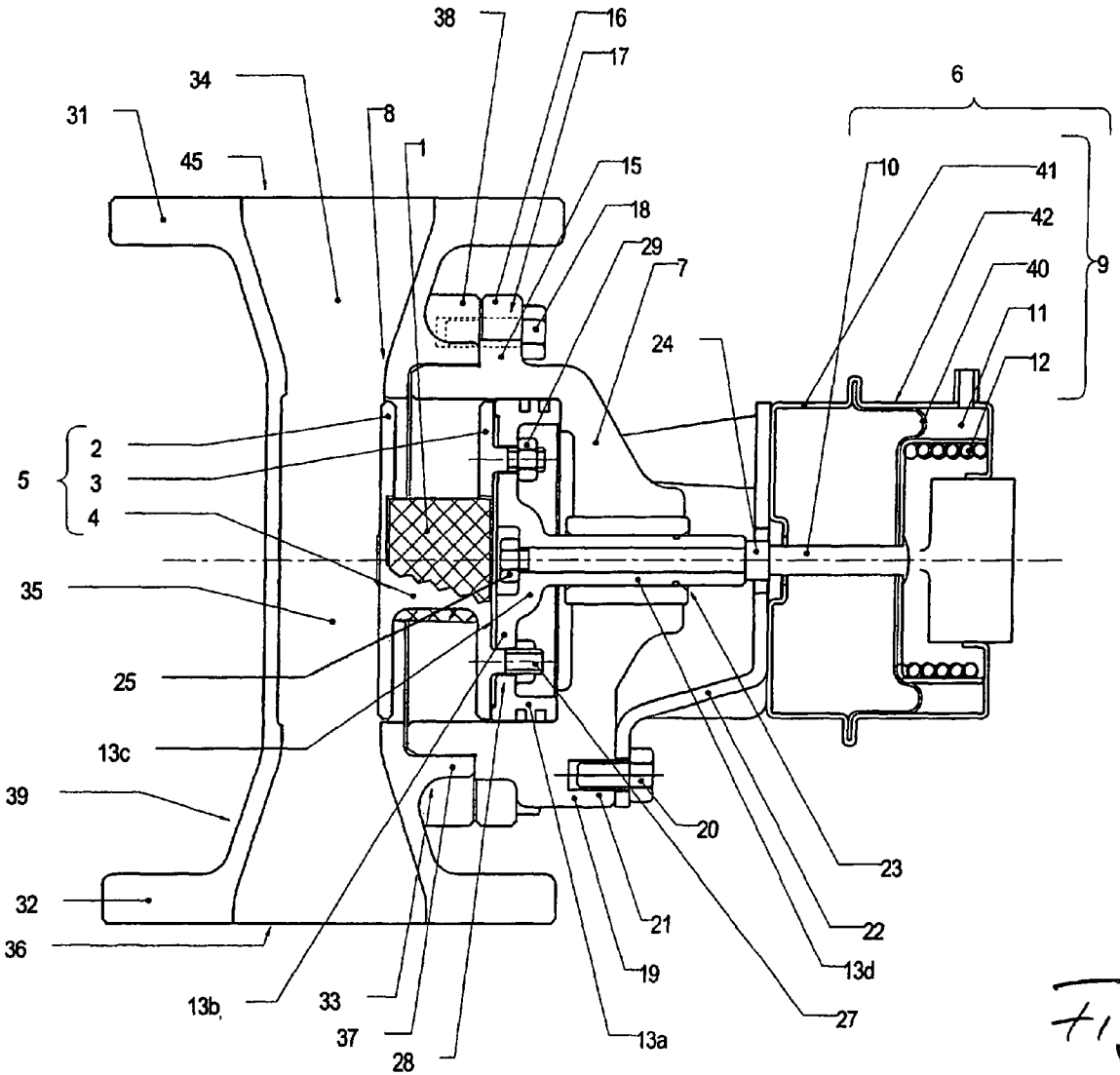
FIG. 2 is a sectional view of the variable position catalyst of FIG. 1, wherein the catalyst body is in an inactive catalyst position.

As mentioned:

FIG. 1 is a sectional view of the variable position catalyst according to an embodiment of the invention, wherein a catalyst body is in an active catalyst position;

FIG. 2 is a sectional view of the variable position catalyst of FIG. 1, wherein the catalyst body is in an inactive catalyst position.

A variable position catalyst according to the embodiment shown in FIG. 1 substantially includes a catalyst holding structure (cradle) 5, a catalyst actuating structure 6, and a catalyst housing 7. The catalyst, actuating structure 6 can be actuated so as to move the catalyst holding structure 5 from the catalyst housing 7 to an active catalyst position in which a catalyst body 1 held by the catalyst holding structure 5 is exerted to an exhaust stream flowing in an exhaust passage 8. Alternatively, the catalyst actuating structure 6 can be actuated so as to move the catalyst holding structure 5 back to the catalyst housing 7. The catalyst body 1 is a miniature catalyst of approximately 24 cc which due to its small size provides the characteristic of a fast light-off. Thus, cold-start emissions can be absorbed at an early stage.

The catalyst holding structure 5 is formed of stainless-steel and includes two disk-shaped plates 2, 3 having equal contours and being arranged coaxially at a certain distance so as to hold the catalyst body 1 therebetween. The plates 2, 3 are connected to each other via two thin walled posts 4 bended to match the curvature of the outer circumference of the plates 2,3. The posts 4 are arranged substantially parallel to each other and to the direction of the exhaust stream. Two threaded pins 27 axially protrude from the side of the plate 3 which faces the catalyst housing 7.

The catalyst actuating structure 6 includes a pneumatic actuator 9 operatively connected with a rod 10. A diaphragm 40 is disposed between two half shells 41, 42 of the pneumatic actuator 9 so as to create a chamber 11 of a variable volume. The pneumatic actuator 9 is set onto a table-like supporting structure having three legs 22 for mounting the actuator 9 to the catalyst housing 7.

A spring 12 is disposed inside the chamber 11 for urging the diaphragm 40 to a position of the maximum volume of the chamber 11. A negative pressure can be applied to the chamber 11 so as to urge the diaphragm 40 against the force of the spring 12 to a position of a smaller volume of the chamber 11. When the negative pressure in the chamber 11 is-released, the diaphragm 40 and thus the rod 10 are moved to their original position by the force of the spring 12.

The catalyst housing 7 provides a cylindrical catalyst chamber 14 having an inner diameter matching to the outer diameter of the disk-shaped plates 2, 3. The catalyst chamber 7 is dimensioned such as to be able to fully accommodate the catalyst holding structure 5. The catalyst chamber 14 is fully opened to an exhaust stream side and has a small diameter bore 23 to the actuator side. Thus, when the catalyst holding structure 5 is fully accommodated in the catalyst chamber 7, the outer surface of the disk-shaped plate 2 is in alignment with the inner wall of the exhaust passage 8 so as not to disturb the exhaust stream. Furthermore, a radially extending bulge 15 is formed at the outside of the catalyst housing 7 and surrounds the catalyst chamber 14 at an axial middle portion thereof.

Four bosses 16 are dispersed over the circumference of the bulge 15 of the catalyst housing 7 at equal intervals and are provided with bores 17 axially penetrating the bosses 16 so as to be able to receive bolts 18. Additionally, three axially extending column-shaped projections 19 protrude from the bulge 15 to the actuator side of the catalyst housing 7. The column-shaped projections 19 are provided with threaded blind holes 21 so as to receive bolts 20. The actuator 9 is mounted to the catalyst housing 7 by screwing the legs 22 to the column-shaped projections 19 by means of the bolts 20.

A mounting element 13 is provided as a linkage of the catalyst holding structure 5 to the actuator 9. The mounting, element 13 is substantially disk-shaped and provides an outer diameter matching to the inner diameter of the catalyst chamber 14. The mounting element 13 is substantially constituted by a leading portion 13*a*, a ring portion 13*b*, a transition portion 13*c* and a tubular portion 13*d*.

The leading portion 13*a* is disposed at the outer circumference of the mounting element and extends axially towards the actuator side of the catalyst housing 7. The ring portion 13*b* extends radially inward from the leading portion 13*a* to the transition portion 13*c* which is offset towards the actuator side of the catalyst housing 7 with respect to the ring portion 13*a*. Finally, the innermost portion of the mounting element 13 is the tubular portion 13*d* which is axially extending to the actuator side along a relative long distance. The ring portion 13*b* is provided with through holes 28 for receiving the threaded pins 27 of the catalyst holding structure 5.

For assembling the structure, the mounting element 13 is slid over the rod 10 until it abuts against a stopper 24 of the rod 10, and is subsequently fixed thereto by means of a nut 25 screwed to a thread formed at the end of the rod 10 opposed to the stopper 24. Then, the catalyst holding structure 5 is fixed to the mounting element 13 by inserting the dowel pins 27 into the through holes 28 of the ring portion 13*b* and tightening the same by means of nuts 29. In this way, the catalyst holding structure 5 is fixed to the mounting element 13 having the rod 10 extending through its tubular portion 13*c* and projecting therefrom.

The thus assembled structure of the catalyst holding structure 5, the mounting element 13 and the rod 10 can be inserted into the catalyst chamber 14 with the rod 10 and the tubular portion 13*c* passing through the through hole 23 so as to couple the rod 10 to the actuator 9. As a result, the variable position catalyst is established.

Now, the integration of the variable position catalyst into the exhaust line of the engine having a turbochargers explained.

A connector element 39 constitutes a part of an exhaust piping lying upstream of the turbocharger. The shape of the connector element 39 is on the one hand determined by an active catalyst portion 35 having a cylindrical inner shape so as to receive the catalyst holding structure 5, and is on the other hand determined by an exhaust gas passage portion 34 connecting an inlet 45 and an outlet 36 of the connector element 39. Therein, the axis of the active catalyst portion 35 is coaxial to the axis of the catalyst chamber 14 but is perpendicular to the axis of the exhaust gas passage portion 34. In other words, the shape of the connector element 39 is the encasement of the set union of the exhaust gas passage portion 34 and the catalyst portion 35.

The cross-sectional progress of the exhaust gas passage 34 from the inlet 45 to the outlet 36 follows the transition from the inlet 45 cross-section via the cross-section of the active catalyst portion 35 to the outlet 36 cross-section. These cross sections are different due to pressure requirements and the different shapes of the components.

Additionally, the connector element 39 is equipped with a connecting portion 33 for connecting the variable position catalyst to the connector element 39. The connecting portion 33 provides an opening having the same diameter like the active catalyst portion 35, and a bulge 37 around the opening which is radially offset with respect to the opening. The offset amount of the bulge 37 corresponds to the wall thickness of the catalyst housing 7 such that the latter can be inserted into the inner of the bulge 37 while the inner surface of the catalyst housing 7 is in alignment with the inner rim of the opening.

Furthermore, the bulge 37 is provided with bosses 38 having bores with inner threads. The bosses 38 are dispersed such over the bulge 37 that the bores of the bosses 38 are alignable with the bores of the bosses 17 when the catalyst housing 7 is inserted into the bulge 37 of the connecting portion 33. Thus, the variable position catalyst can be tightly fitted to the connector element 8 by means of screws 18 screwed through the bosses 17 into the bosses 38. Additionally, a sealing means may be disposed between the connecting portion 33 and the catalyst housing 7.

The connector element 39 is integrateable into the exhaust line via flanges 31, 32 disposed at the inlet 45 and the outlet 36 of the passage 34, respectively, by means of common connection techniques.

As a result, with the assembled structure of the variable position catalyst connected to the exhaust gas passage of the engine, the catalyst body 1 can be actuated by means of the actuator 9 such that catalyst body 1 is exposed to the exhaust gas stream flowing in the active catalyst portion or is retracted into the catalyst chamber 14 of the catalyst housing 7 where the catalyst body 1 is not active.

During the operation of the variable position catalyst, the leading edge 13*a* of the mounting element 13 is always in contact with the inner surface of the catalyst chamber 14 such that the catalyst holding structure 5 holding the catalyst body 1 is stably guided in its movement. When the catalyst body 1 is in the active catalyst position, i.e. disposed in the active catalyst portion, a fast light-off-of the relative small catalyst body 1 is achieved, thus providing a conversion of the exhaust content and limiting emissions as desired. Additionally, the turbine of the turbocharger and the conventional catalyst mounted downstream the turbocharger will be heated up such that they will earlier reach their full performance state.

At an appropriate time point, e.g. when the conventional catalyst has reached a temperature for working properly, the catalyst body 1 is withdrawn from the exhaust stream into the catalyst chamber 14 such that the exhaust stream to the turbocharger is not anymore disturbed by the catalyst holding structure 5.

As mentioned, FIG. 1 shows an assembly with the catalyst body 1 in an active position and FIG. 2 shows the assembly with the catalyst body 1 in an inactive position. The assembly includes various features for assembly, and similarly, disassembly. For example, the plate 3 of the cradle 5 includes an opening shaped to accommodate the catalyst body 1. For example, when the transition portion 13*c* is not attached to the cradle 5, the opening may accommodate the catalyst body 1 (e.g., for insertion or removal). Note that the catalyst housing 7 fits to the connector element 39 and, upon disassembly, allows access to the transition portion 13*c*. Specifically, the transition portion 13*c* can move outwardly from the catalyst housing 7 and allow access to the nuts 29 that attach the cradle 5 to the transition portion 13*c*.

The invention is not restricted to the above described embodiment and can be changed in various modifications.

For example, the number of bosses for fixing the variable position catalyst to the connector element or a hydraulic actuator may be varied according to various requirements.

Additionally, the actuator is not limited to a pneumatic actuator and an electrical actuator may be used as well.

Furthermore, the variable position catalyst may also be formed such that both the active and the inactive catalyst position are disposed inside the catalyst housing. In this case, the exhaust piping would be interrupted and both ends thereof would be connected to respective connecting portions, of the catalyst housing.

The invention claimed is:

1. A variable position catalyst assembly, comprising:

a connector element (39) that comprises an opening in an exhaust gas passage portion (34) disposed between an inlet (45) and an outlet (36), the opening shaped to accommodate a catalyst body (1) held by a cradle (5) and the portion (34) shaped to accommodate the catalyst body (1) held by the cradle (5) in an active catalyst position (35) and the inlet (45) and the outlet (36) shaped to connect to exhaust gas piping wherein cross-sectional shape of the exhaust gas passage portion (34) differs from cross-sectional shape of the inlet (45) and cross-sectional shape of the outlet (36);

a catalyst housing (7) configured to mount to the connector element (39) and to accommodate, in an inactive catalyst position (14), the catalyst body (1) held by the cradle (5); and an actuator member (9) that comprises a mounting element (13) for mounting of the cradle (5) and for moving the catalyst body (1) held by the cradle (5) with respect to the catalyst housing (7) such that the catalyst body (1) can be moved to the active catalyst position (35) or to the inactive catalyst position (14), wherein the cradle (5) comprises plates (2, 3) and posts (4) connecting the plates (2, 3) and wherein, in the inactive catalyst position (14), one of the plates (2) covers the opening in the exhaust gas passage portion (34) of the connector element (39).

2. The variable position catalyst assembly according to claim 1, wherein the plates (2, 3) are disc-shaped.

3. The variable position catalyst assembly according to claim 1 or 2, wherein the active catalyst position (35) is exposed to an exhaust gas stream of an engine.

4. The variable position catalyst assembly according to claim 1, wherein at least the inactive catalyst position (14) is provided within the catalyst housing (7).

5. The variable position catalyst assembly according to claim 1, wherein the cradle (5) is connected to the actuator member (9) by an actuator rod (10).

6. The variable position catalyst assembly according to claim 5, wherein the catalyst housing (7) has a cylindrical inner shape and the cradle (5) has a cylindrical outer shape, the inner diameter of the catalyst housing (7) fitting to the outer diameter of the cradle (5).

7. The variable position catalyst assembly according to claim 5 or 6, wherein the cradle (5) comprises two disc-shaped plates (2, 3) between which the catalyst body (1) is held.

8. The variable position catalyst assembly according to claim 1, wherein the actuator member (2) is a pneumatic device.

9. The variable position catalyst assembly according to claim 1, wherein the actuator member (9) is an electric device.

10. The variable position catalyst assembly according to claim 5, wherein the actuator rod (10) moves the catalyst body (1) to the active catalyst position (35) when the actuator member (9) is actuated, and moves the catalyst body (1) to the inactive catalyst position (7) when the actuator (9) is released.

11. The variable position catalyst assembly according to claim 1, wherein the catalyst body (1), the catalyst housing (7) and the actuator member (9) comprise one common axis along which the catalyst body (1) is movable.

12. The variable position catalyst assembly according to claim 11, wherein the actuator member (9) is located outside the catalyst housing (7), and the actuator rod (10) penetrates the catalyst housing (7) along the common axis.

13. The variable position catalyst assembly according to claim 5, wherein the cradle (5) comprises a leading edge (13*a*) which is always in contact with a portion of the catalyst housing (7) providing the inactive position (14).

14. The variable position catalyst assembly according to claim 1, wherein the variable position catalyst is provided upstream of a turbocharger of an engine.

15. An internal combustion engine, wherein an exhaust gas of the engine is passed through an exhaust gas passage, the combustion engine further comprising a variable position catalyst assembly having:

a connector element (39) that comprises an opening in an exhaust gas passage portion (34) disposed between an inlet (45) and an outlet (36), the opening shaped to accommodate a catalyst body (1) held by a cradle (5) and the portion (34) shaped to accommodate the catalyst body (1) held by the cradle (5) in an active catalyst position (35) and the inlet (45) and the outlet (36) shaped to connect to exhaust gas piping of the exhaust gas passage wherein cross-sectional shape of the exhaust gas passage portion (34) differs from cross-sectional shape of the inlet (45) and cross-sectional shape of the outlet (36);

a catalyst housing (7) configured to mount to the connector element (39) and to accommodate, in an inactive catalyst position (14), the catalyst body (1) held by the cradle (5); and an actuator member (9) that comprises a mounting element (13) for mounting of the cradle (5) and for moving the catalyst body (1) held by the cradle (5) with respect to the catalyst housing (7) such that the catalyst body (1) can be moved to the active catalyst position (35) or to the inactive catalyst position (14), wherein the cradle (5) comprises plates (2, 3) and posts (4) connecting the plates (2, 3) and wherein, in the inactive catalyst position (14), one of the plates (2) covers the opening in the exhaust gas passage portion (34) of the connector element (39).

16. The internal combustion engine according to claim 15, wherein the plates (2, 3) are disc-shaped.

17. The internal combustion engine according to claim 15 or 16, wherein the active catalyst position (35) is exposed to an exhaust gas stream of the engine.

18. The internal combustion engine according to claim 15, wherein at least the inactive catalyst position (14) is provided within the catalyst housing (7).

19. The internal combustion engine according to claim 15, wherein the catalyst body (1) is held by the cradle (5), the cradle (5) connected to the actuator member (9) by the mounting element (13) and an actuator rod (10).

20. The internal combustion engine according to claim 19, wherein the catalyst housing (7) has a cylindrical inner shape and the cradle (5) has a cylindrical outer shape, the inner diameter of the housing fitting to the outer diameter of the cradle (5).

21. The internal combustion engine according to claim 19 or 20, wherein the cradle (5) comprises two disc-shaped plates (1, 2) between which the catalyst body (1) is held.

22. The internal combustion engine according to claim 15, wherein the actuator member (9) is a pneumatic device.

23. The internal combustion engine according to claim 15, wherein the actuator member (9) is an electric device.

24. The internal combustion engine according to claim 23, wherein the actuator rod (10) moves the catalyst body (1) to the active catalyst position (35) when the actuator member (9) is actuated, and moves the catalyst body (1) to the inactive catalyst position (14) when the actuator (9) is released.

25. The internal combustion engine according to claim 15, wherein the catalyst body (1), the catalyst housing (7) and the actuator member (9) comprise one common axis along which the catalyst body (1) is movable.

26. The internal combustion engine according to claim 25, wherein the actuator member (9) is located outside the catalyst housing (7), and the actuator rod (10) penetrates the catalyst housing (7) along the common axis.

27. The internal combustion engine according to claim 19, wherein the cradle (5) comprises a leading edge (13*a*) which is always in contact with a portion of the catalyst housing (7) providing the inactive position (35).

28. The combustion engine according to claim 27, wherein a part of the catalyst housing (7) constitutes a part of the exhaust gas passage.

29. The combustion engine according to claim 15, further comprising a turbocharger for compressing the air to be supplied to the combustion engine, wherein the variable position catalyst assembly is disposed upstream of the turbocharger.

* * * * *